United States Patent [19]

Tissot

[11] 4,362,393

[45] Dec. 7, 1982

[54] CHESS CLOCK

[76] Inventor: Pierre L. Tissot, 863 Via de la Paz, Pacific Palisades, Calif. 90272

[21] Appl. No.: 207,687

[22] Filed: Nov. 17, 1980

[51] Int. Cl.[3] ..... G04F 3/00

[52] U.S. Cl. ..... 368/96; 368/10; 235/92 T

[58] Field of Search ..... 368/3, 1, 9, 10, 89, 368/96, 107, 108, 110, 113, 114, 118, 120; 364/705, 708–710, 410; 273/260, 148 R

[56] References Cited

U.S. PATENT DOCUMENTS

| | | | |
|---|---|---|---|
| 3,698,180 | 10/1970 | Klein | 368/3 |
| 4,140,897 | 2/1979 | Guerra | 364/705 |
| 4,151,596 | 4/1979 | Howells | 364/709 |
| 4,220,992 | 9/1980 | Blood et al. | 364/709 |

OTHER PUBLICATIONS

Radio Electronics, vol. 46, No. 11, pp. 43–45, Nov. 75, Simple Circuit ADOS Elapse Time Measurement Feature to Basic Calculator Operation.

Electronics Australia, May 76, pp. 69, 71. "Simple Circuit Converts Calculator to Stop Watch," Brury.

Elektor, Jul./Aug. 1979, Calculator as a Chess Clock, vol. 51/52, No. 7–8, 7–41–7–42.

*Primary Examiner*—Bernard Roskoski

*Attorney, Agent, or Firm*—Ralph B. Pastoriza

[57] ABSTRACT

A casing with common padded first and second cavities holds two self-contained, battery-operated, commercial, digital-electronic pocket-calculators in a removable fashion. The "equal/repeat" keys of both calculators are brought out to calculator-embedded contacts by the manufacturer. The casing further includes a rocking rod, two micro switches, a battery and a control circuit. The control circuit develops "shorts" spaced by one second time intervals. The calculators are used as time-pre-programmed, decrementing, by seconds, time, scorekeepers as the shorting pulses are applied to the one calculator whose owner's move it is in a game of speed chess. The calculators and other parts are consumer-replaceable.

5 Claims, 9 Drawing Figures

CHESS CLOCK

This invention relates broadly to electronic portable pocket calculators and more particularly to the use of such calculators in a modified form to provide a timing apparatus for speed chess.

BACKGROUND OF THE INVENTION

The preferred use for applicant's present invention is in a timing apparatus for speed chess and for illustrative purposes, the preferred embodiment will be described in conjunction with this use.

In speed chess, there are normally provided two clocks or timers, one associated with each player. To play the game, each player is assigned a predetermined length of time to checkmate the other. Thus, one player will first start the operation of the opponent's clock and the opponent must then make his move and after the move is completed will stop his clock and simultaneously start the first player's clock. The first player must then make a move and he will then stop his clock and start the opponent's clock. As a result, the time that each player spends making his own moves is totalled automatically in his clock and if that player has not achieved a check mate within the pre-arranged time, he loses. By assigning different time lengths to the players, a poor player can be allotted more time and thus gain a better advantage with a more experienced chess player.

The prior art chess clocks available are subject to considerable abuse by speed chess players since, in the excitement of the game, they will often manually pound the start and stop mechanisms of the clocks and ultimately damage the clocks or cause them to wear out much sooner than would be normal.

In addition to the foregoing problems, there is not really any appropriate indication as to when a player's allotted time is up; that is, has been completed relative to the opponent's time should both allotted time-spans end almost simultaneously. In other words, to avoid the prior art ambiguity, a permanent optical record equivalent to a "photo finish" in horse racing is needed. Nor is there any easy manner of determinging how much longer, after the allotted time has elapsed, the player has needed to complete a move or further moves.

Finally, where non-digital type clocks are employed, they are difficult for the players to read quickly.

BRIEF DESCRIPTION OF THE PRESENT INVENTION

The foregoing problems with prior art chess clocks are solved by the present invention, the heart of which constitutes a readily available electronic portable pocket calculator modified only to the extent that first and second spaced accessible contacts are brought out and exposed on a surface portion of the calculator, these contacts being wired in parallel with the equal/repeat key of the calculator. As a consequence, momentary short circuiting of these contacts effects the same function in the calculator as pressing and releasing the equal/repeat key.

An additional calculator to that described above is provided to result in first and second calculators which serve as timers for the respective chess players. By now providing a control circuit which will effectively generate a short circuit at consistent spaced time intervals of one second, and by alternately connecting this control to the spaced contacts on the first and second calculators, they can be caused to count downwardly from any pre-programmed number of seconds set into the calculators.

In accord with the present invention, appropriate switching of the control circuit between the first and second calculators is accomplished by a rocking rod which is mechanically decoupled from the calculators themselves so that pounding of the rod by the players does not affect the calculators.

Since the calculators are mass produced items, they can readily be replaced. Not only do they provide a large, clearly readable digital display but have the added feature of producing a negative sign when the pre set-in count has been exceeded.

BRIEF DESCRIPTION OF THE DRAWINGS

A better understanding of this invention as well as various further features and advantages thereof will be had by now referring to the accompanying drawings in which.

DETAILED DESCRIPTION OF THE INVENTION

Figure 1:
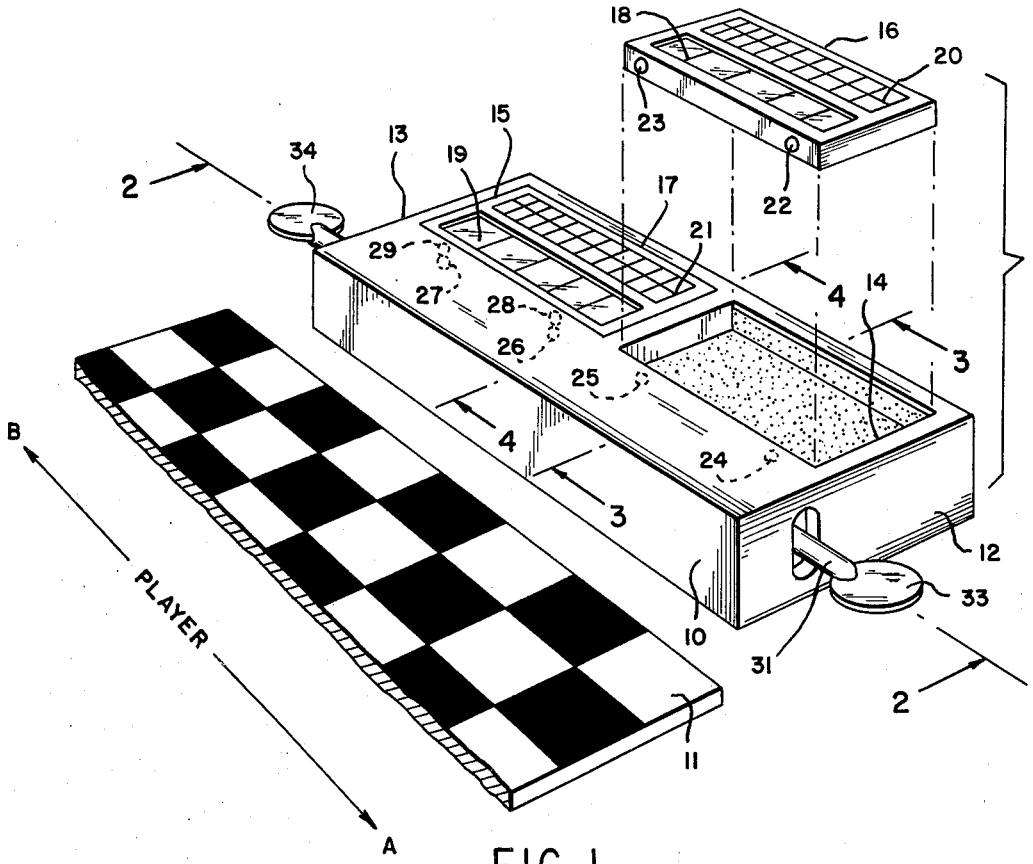
FIG. 1 is a perspective view, partly exploded illustrating a chess clock incorporating the calculators of the present invention.

Referring first to FIG. 1, the chess clock of this invention includes a shock resistant casing 10, positionable on a table to one side of a chess board 11. Casing 10 has first and second ends 12 and 13 with first and second cavities 14 and 15 formed in its top surface adjacent to these ends respectively.

First and second electronic calculators 16 and 17 each having digital read-out type displays 18 and 19 are shown in FIG. 1. The calculator 16 is shown exploded above the cavity 14 to indicate that the same can be readily removed or received in the cavity. In this respect, each of the cavities 14 and 15 are dimensioned to receive and hold the calculators with their displays clearly visible on the top surface of the casing 10.

Each of the calculators 16 and 17 is identical and has an equal/repeat key 20 and 21. Further, each calculator has first and second spaced equal/repeat key contacts on one side connecting in parallel with the circuit closed by the equal/repeat key when depressed. By an equal/repeat key is meant a key means having contacts which, when closed, will actuate means in the calculator for automatically repeating the previously performed function of the calculator. For example, if the previously performed function was a subtraction of 1 from a number displayed by the calculator, successive operations of the equal/repeat key will result in successive subtractions of 1 from the display number so that there would be displayed a "countdown".

First and second spaced cavity contacts in a side wall of each of the cavities 14 and 15 are provided and positioned to be engaged in electrically conducting relationship with the equal/repeat key contacts when the calculators are received in the cavities. Thus, with specific reference to the calculator 16, the first and second spaced equal/repeat key contacts are shown at 22 and 23 and the corresponding first and second cavity contacts are indicated at phantom lines at 24 and 25 so that when the calculator 16 is received in the cavity 14, electrical connection will be effected between the contacts 22, 24 and the contacts 23, 25.

Similarly, and as indicated by the phantom lines, the second calculator 17 has its spaced equal/repeat key contacts 26 and 27 positioned to engage the corresponding spaced cavity contacts 28 and 29 when received in the cavity 15.

Figure 2:
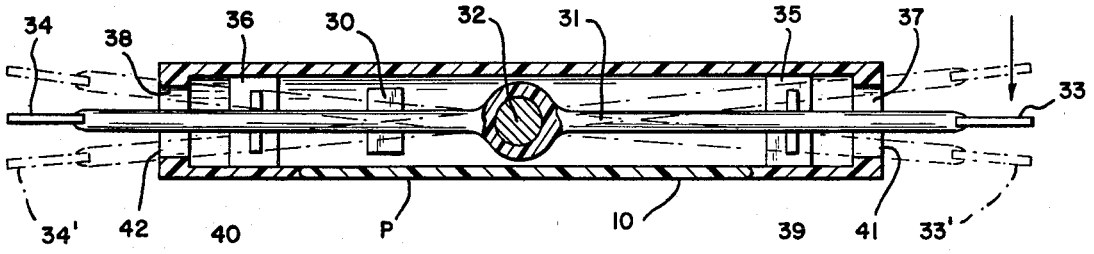
FIG. 2 is a cross section taken in the direction of the arrows 2—2 of FIG. 1.

Referring now to the cross section of FIG. 2, there is indicated by the block 30 a circuit means in the casing 10 for repeatedly providing a short circuit at precisely timed intervals of one second. In this respect, and as will become clearer as the description proceeds, the block 30 which may be in the form of a chip serves to provide a direct electrical connection or "short" between the cavity contacts 24 and 25 when connected thereto or alternatively between the cavity contacts 28 and 29, when connected thereto.

The foregoing alternate connections to one or the other of these cavity contacts is accomplished by a rocking rod shown at 31 transversely pivoted on a steel shaft 32 within the casing with the ends of the rod terminating in small paddles 33 and 34 adjacent the first and second ends of the casing 10. This rocking rod is arranged to actuate switch means in the form of first and second micro switches indicated in FIG. 2 at 35 and 36 when rocked between first and second positions.

The amplitude of rocking movement of the switch rod 31 is controlled by vertical end slots 37 and 38 in the casing 10. The rod is arranged to be detented to either one rocked position or the other by the feelers 39 and 40 in micro switches 35 and 36, the operation of which will be described in greater detail subsequently.

Appropriate bottom portions 41 and 42 serve as stops at the bottom ends of each of the slots 37 and 38 for the pounding action when the rod 31 is rocked to one position or the other.

The angular degree of rocking of the rod 31 is about 20°, 10° above and below a central neutral position. Thus, there is indicated a rocking of the rod 31 to a first position by the phantom line 33' against the slot end 41. A second position for the rocking rod 31 is shown in phantom lines at 34' to the left in FIG. 2. The arrangement is such that the micro switch 35 is closed when the rod is rocked to the first position shown in phantom lines at 33' while the second microswitch 36 is closed when the rod is rocked to the second position shown in phantom lines at 34'.

Because the rod 31 is pivoted and must rock as shown, it is impossible to have both of the microswitches 35 and 36 actuated simultaneously. One is always turned off when the other is turned on. Or, both are off when the rod is in a central or neutral position as illustrated in solid lines in FIG. 2.

Figure 3:
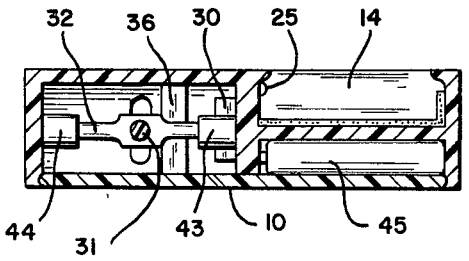
FIG. 3 is a cross section taken in the direction of the arrows 3—3 of FIG. 1.

In the cross section of FIG. 3, it will be noted that there are provided substantial bearings 43 and 44 for the steel shaft 32 supporting the rocking rod 31. The rocking rod 31 itself may be made of a molded plastic, the widened circular shaped end paddles 33 and 34 constituting integral portions of the rod. The paddles and slots are dimensioned such that when the paddles are oriented into a vertical plane, they can pass through the slots to facilitate assembly of the structure.

In FIG. 3 there is shown beneath the cavity 14 a lower area which may be used to house a battery 45 for providing energy to the control circuitry chip 30.

Figure 4:
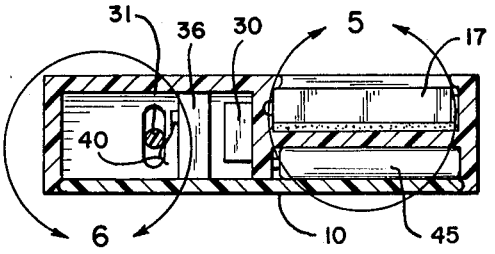
FIG. 4 is a cross section taken in the direction of the arrows 4—4 of FIG. 1.

In FIGS. 2, 3 and 4, it will be noted that the floor or bottom of the casing 10 is in the form of a snap plate which can be snapped out to open up or provide access through the bottom of the casing when it is desired to change the battery or to gain access to the other components within the casing. No screws are involved but rather, the snap plate indicated at P is simply deformed slightly to snap into the craddling molded structure of the casing walls.

FIG. 4 is a cross section taken through the cavity 15 receiving the second calculator 17. Also, there is illustrated in FIG. 4 to the left, the detenting microswitch feeler 40.

Portions of the structure illustrated in FIG. 4 enclosed within the circular arrows 5 and 6 will now be described in detail with reference to these latter figures.

Figure 5:
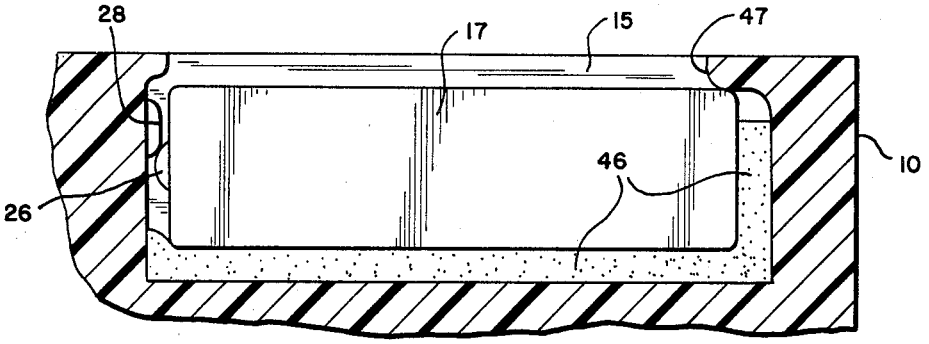
FIG. 5 is a greatly enlarged fragmentary cross section of that portion of the cross section of FIG. 4 enclosed within the circular arrow 5.

Referring first to FIG. 5, it will be noted that the cavity 15 for the second calculator 17 has its floor and side wall engaging the side of the calculator opposite the side having the first and second spaced equal/repeat key contacts, lined with a resilient cushioning material 46. The portion of this material lining the side wall serves to bias the calculator body 17 away from this side wall to provide a pressing contact of the equal/repeat key contacts with the spaced cavity contacts. In this respect, the key contact 26 is shown in engagement with the cavity contact 28, these contacts having been referred to heretofore and shown in FIG. 1 in phantom lines by the same numerals. It will be noted that the cavity contact 28 is spaced vertically slightly higher than the key contact 26 so that the cavity contacts actually help in holding the calculator 17 within the cavity. A further aid in holding the calculator in position is an overlying lip portion 47 of the side wall having the resilient lining 46. It can be seen that with the arrangement of FIG. 5, the calculator 17 can easily be removed from the cavity by simply urging it to the right as viewed in FIG. 5 to compress the resilient material 46 until the key contact 26 is free of the cavity contact 28. The calculator can then be lifted out from the recess and from under the lip portion 47.

The foregoing described arrangement of the resilient cushioning material and positioning of the respective contacts constitutes an important feature of this invention in that it assures that a proper pressing electrical engagement is effected between the key contacts and the cavity contacts and also assures that the calculator 17 will be properly retained in position, all without the use of special clamps and the like. Thus, when a consumer removes the calculator, he automatically breaks the connection between the contacts and similarly when he inserts the calculator, he automatically makes the proper connections between the contacts.

Figure 6:
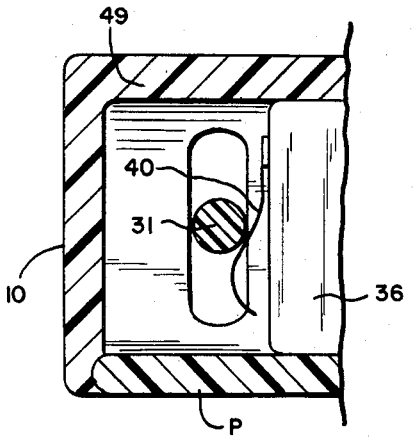
FIG. 6 is another fragmentary enlarged cross section of that portion of the structure of FIG. 4 enclosed within the circular arrow 6.

Referring now to FIG. 6, details of the detenting feeler action will be explained. As shown, the rocking rod 31 is in a center or neutral position, the feeler spring 40 passing below the rod 31 in this center position.

Figure 7:
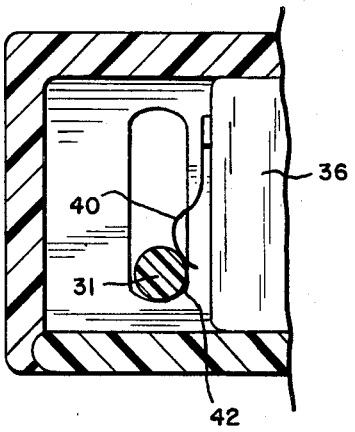
FIG. 7 is a view similar to FIG. 6 but showing a second position of the switch rod element illustrated.

FIG. 7 shows the rocking rod 31 moved down to its heretofore referred to second position wherein it will be noted that the feeler 40 will detent the rod 31; that is, hold it in this position because of the outer bulge of the feeler above the rod 31.

Figure 8:
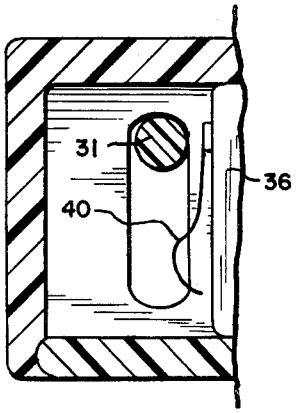
FIG. 8 is a view similar to FIG. 6 but showing a first position of the switching rod; and, FIG. 9 is a diagramatic illustration of electrical functions carried out by the chess timer useful in explaining its operation.

FIG. 8 shows the rod 31 in its first rocked position and again it will be noted that the bowing of the feeler 40 will detent the rod 31 to this position.

It can also be noted from FIGS. 6, 7 and 8 that the second microswitch 36 is open when the rod 31 is in the neutral position shown in FIG. 6 or its first position shown in FIG. 8 and only closed when the rod 31 is in its second position illustrated in FIG. 7.

It can be appreciated that the first microswitch 35 illustrated in FIG. 2 is operated in a similar manner and it will also be clear from the geometry that only one microswitch can be closed at a time.

Because the rod is isolated from the calculators and offset to one side of the calculators, even should the rod be pounded as a consequence of the excitement of chess players, minimal reaction will occur on the calculators themselves. Further, by offsetting the rocking rod from the calculators themselves, the possibility of a player hitting the calculator keys rather than the paddle portions of the rocking rod is minimized.

The use of the microswitch feeler as a detenting means provides for a very smooth and silent type of detent structure.

Figure 9:
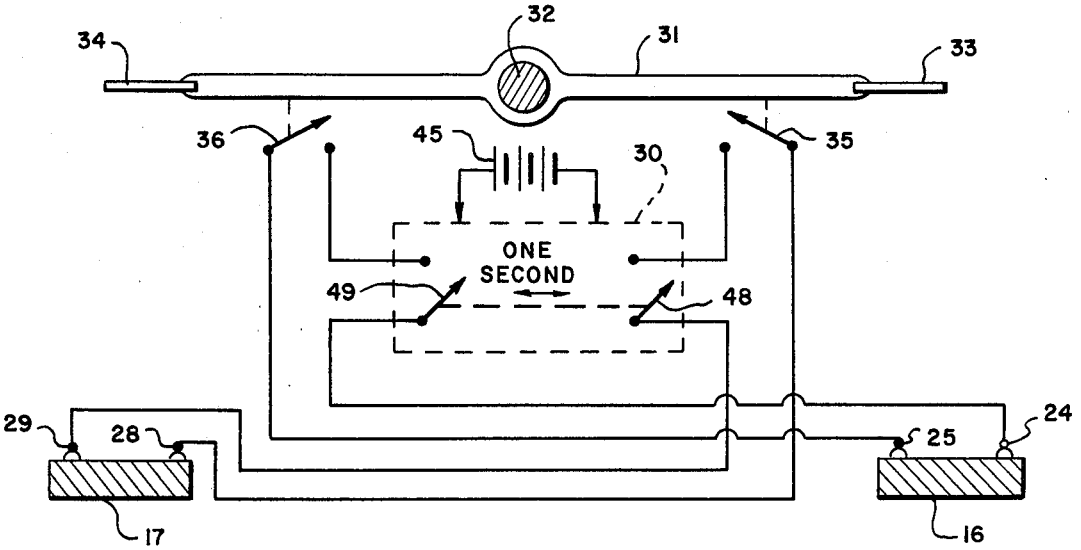

Referring now to FIG. 9, there is shown a schematic electrical circuit diagram useful in explaining the operation of the chess clock of this invention. In FIG. 9, the control circuit in the form of the chip 30 described in FIG. 2 is schematically illustrated within the dashed outline designated by the same numeral 30 in FIG. 9. Essentially, this chip will provide for independent short circuiting of the first and second spaced cavity contacts 24, 25 and 28, 29 described in FIG. 1 at one second intervals. Towards this end, such short circuiting is schematically indicated by means of switches 48 and 49 repetetively actuated to close at one second intervals, the battery 45 being provided to supply the necessary energy. While the switches shown are mechanical, it will be understood that they merely represent electronic switches such as transistors wherein appropriate base applied pulses will effect the desired opening and closing.

The first and second microswitches 35 and 36 described in FIG. 2 are schematically indicated by the same numerals 35 and 36 in positions to be closed by rocking of the rod 31 about the pivot shaft 32.

Finally, the first and second calculators 16 and 17 described in FIG. 1 are again schematically indicated by the block 16 and 17 in FIG. 9 with their equal/repeat key contacts in engagement with the cavity contacts 24, 25 and 28, 29 respectively.

It can now be appreciated that when the rocking rod 31 is rocked to a first position wherein the paddle portion 33 is urged downwardly, the microswitch 35 will be closed thereby resulting in one second interval short circuits being applied to the second cavity spaced contacts 28 and 29 to the second calculator 17 thereby resulting in a down counting of this calculator as will be explained subsequently.

When the rocking rod 31 is moved to a second position by depression of the paddle portion 34, the microswitch 35 is opened and the microswitch 36 is closed, thereby applying the one second short circuit intervals to the first cavity spaced contacts 24 and 25 engaging the contacts for the calculator 16 and thus operating that calculator to count down.

When the rod 31 is in a center position as shown in FIG. 9, both microswitches 35 and 36 are opened.

OPERATION

To illustrate the operation of the chess clock as described, assume that there are two chess players A and B as schematically depicted in FIG. 1 of distinctly unequal playing strengths and that they desire to play a game of "speed chess" using the chess clock of this invention. Both of the players agree to a "five and ten minute game" whereby A, the stronger player, gets only half of B's playing time.

Assume A draws black. He has earned the right to choose the clock location. If A is right handed, he will prefer the right side and place the case 10 on his right side adjacent to the chess board 11 as shown in FIG. 1. Next, the rocking rod is placed "in neutral"; that is, with its axis horizontal as shown in solid lines in FIGS. 2 and 6, so that both of the microswitches 35 and 36 as shown in FIG. 9 are opened. Calculators 16 and 17 are turned on and the "entry-clear" keys are depressed to clear the entries thereon. A's calculator 16 is programmed to show on the display the number 301 and the minus sign key is then depressed and then the numeral 1 depressed to effect a substraction. When the equal/repeat key 20 is now depressed, the display 18 will read 300 seconds.

B's calculator 17, in turn is programmed to show on the display the numbers 601. The minus key and then the numeral 1 key is depressed to provide for a subtraction of minus 1 and then the equal/repeat key 21 is depressed so that the display 19 will read 600 seconds.

It will now be understood that with the calculators programmed as described above, any further depression of the equal/repeat keys 20 and 21 will effect a subtraction of minus one from the displayed quantity so that successive operations of this key would result in a count-down from the initially programmed numbers 300 and 600 respectively. Since the same function of operation of the equal/repeat key is achieved by short circuiting the spaced contacts 22, 23 on the calculator 16 and 26, 27 on the calculator 17, it can now be appreciated that when the rocking rod 31 is moved to a first position, the one second shorting interval supplied by the chip 30 will be passed to the second calculator 17 whereas when the second switch means 36 is closed by rocking the rod 31 to a second position, the one second interval short circuits will be passed to the first calculator 16.

Continuing on with the description of the speed chess game, with the settings in the calculators as described, the total game cannot last longer than a combined time of 15 minutes, but may, of course, be terminated sooner if one player resigns. There is neither a minute or an hour read-out. Seconds are much preferred by speed-players. Player A who has the black pieces will first obtain an acknowledgment from player B to start and upon receiving this acknowledgment, player A depresses his side of the rod 30; to wit, the paddle 33 thus starting player B's calculator 17 to steadily lose time. Player B now makes his opening move and thereupon only is he permitted to depress his side of the rod 30; that is, the paddle 34, thereby arresting his calculator 17 and starting A's calculator 16. In this latter operation, the player must use the same hand he just used to move his chess men. Neither player is permitted to touch (lift up) a chess clock during a game other than by operating the rocking rod 31. With the chess clock of the present invention, there will be no temptation to lift up the clock for examination since the bright read-out is directly visible from above. Prior art chess clocks require a sideways squinting onto vertically oriented clock or display faces. Horizontal displays are a major improvement and an important feature of this invention.

The rocking rod 31 is operated back and forth by the players and eventually the loser will reach zero on his display and a silent "transition-less" time incrementing now with a negative prefix, takes place. In other words, after the time runs out, a negative sign appears on the calculator and further countdown takes place in the negative direction.

According to existing rules, the winning player must verbally announce that he won "on Time". The "winner" deeply engrossed in the game oftentimes does not realize this. The "loser" quietly continues playing, hoping for the appearance of the "time out" signal (provided on conventional clocks) or the appearance of the negative sign on the "winner's" display before the "winner" yells "time". If the call by the winner is not forthcoming, then the "loser" may successfully claim the game a draw.

The "forward-carrying" of a loser's time-gap settles the old argument as to "whose clock fell first", a constant occurrence with prior art chess clocks where minute clock-hand discrepancies are either unrecognizable as such and/or are oftentimes quickly cancelled with a cheating button-turning. The cumbersome resetting of clock-hands after every (very popular five minute) game is now replaced by a rapid fingertipping without the need to lift up and manipulate the clock.

In addition, annoying re-winding, often forgotten with one-sided stalling, is obviated. Constant change of the clock location, (to cancel out uneven clock-speeds) is no longer needed.

From all of the foregoing, it can now be appreciated that the present invention particularly when embodied in the chess clock described, overcomes many of the problems heretofore encountered with prior art chess timing devices.

I claim:

1. A chess clock, including, in combination: an electronic, portable pocket calculator including means, when actuated, for automatically repeating the previously performed function of the calculator, an equal/repeat key for actuating said means and first and second spaced accessible contacts exposed on a surface portion of said calculator, wired in parallel with said equal/repeat key so that momentary short circuiting of said contacts effects the same function in said calculator as pressing and releasing said equal/repeat key; additional first and second spaced contacts for engagement with said first mentioned first and second spaced contacts respectively; a control circuit for short-circuiting said additional first and second spaced contacts at a given repetition frequency; and switch means for connecting when closed and disconnecting when opened said control circuit to said additional first and second spaced contacts whereby said calculator and control circuit constitute a countdown device during a period defined by the lengths of time said switch means is closed.

2. A chess clock according to claim 1, including an additional electronic portable pocket calculator identical to said first mentioned portable calculator; additional switch means for connecting when closed and disconnecting when opened said control circuit to the additional first and second spaced contacts on said additional calculator; and a manually operable switch rod mounted for rocking movement such that when rocked to a first position, said additional switch means is closed and said first mentioned switch means is opened, and when rocked to a second position, said additional switch means is opened and said first mentioned switch means is closed whereby two chess players can pre-program time periods into said calculators and then operate the rocking rod to thereby provide a speed chess timing apparatus, the sign of the countdown numbers displayed on the calculators changing when a pre-programmed count has been exceeded.

3. A chess clock including, in combination:

(a) a shock resistant casing positionable on a table to one side of a chess board, said casing having first and second ends with first and second cavities formed in its top surface adjacent to said ends respectively;

(b) first and second electronic calculators each having digital read-out type displays, said cavities being dimensioned to receive and hold said calculators respectively with their displays clearly visible on said top surface, each of said calculators being identical and having means, when actuated, for automstically repeating the previously performed function of the calculator, an equal/repeat key for actuating said means and first and second spaced equal/repeat key contacts on one side connecting in parallel with the means actuated by said equal/repeat key when depressed;

(c) first and second spaced cavity contacts in a side wall of each of said cavities engaged in electrically conducting relationship by said equal/repeat key contacts;

(d) circuit means in said casing for repeatedly providing a short circuit at precisely timed intervals of one second;

(e) an elongated rod essentially transversely pivoted to said casing with its first and second ends adjacent to said first and second ends of said casing, respectively, for convenient manual rocking by chess players at opposite sides of said chess board in first and second directions to assume first and second positions respectively; and, (f) switch means in said casing responsive to rocking of said rod to said first position to connect said circuit means to said first and second cavity contacts in said second cavity and responsive to rocking of said rod to said second position to connect said circuit means to said first and second cavity contacts in said first cavity, whereby different or similar pre-programmed numbers can be set into said calculators and a game of speed chess can be played, each calculator displaying the number of seconds remaining for a corresponding player to finish the game and each calculator displaying a negative sign when the pre-determined number for the countdown has been exceeded.

4. A chess clock according to claim 3, in which each of said cavities has its floor and side walls engaging the side of the received calculator opposite the side having said first and second spaced equal/repeat key contacts, lined with a resilient cushioning material, the portion of said material lining said side wall biasing the calculator body away from said side wall to provide a pressing contact of said equal/repeat key contacts with said cavity contacts, said side wall having an overlying lip to hold said calculator within said cavity, the cavity contacts being spaced slightly higher than the equal/-repeat key contacts to thereby hold in the opposite side of the calculator while simultaneously providing a reliable electrical connection.

5. A chess clock according to claim 3, in which said casing includes a hollow interior adjacent to said first and second cavities opening out in elongated vertical slots at said first and second ends of said casing respectively, said rod being pivotally mounted within said hollow portion with its first and second ends extending through said elongated slots to terminate in flat paddle structures for easy manual engagement, the bottom of each elongated slot being engaged by said rod when said rod is operated, each of said switch means comprising a microswitch with a curved feeler element adjacent to the slots serving as a detenting means to detent the rod to its said first or second position.

* * * * *